US005079482A

United States Patent [19]

Villecco et al.

[11] Patent Number: 5,079,482

[45] Date of Patent: Jan. 7, 1992

[54] DIRECTED ELECTRIC DISCHARGE GENERATOR

[76] Inventors: Roger A. Villecco, 845 Blvd. de L'Orleans, Mary Ester, Fla. 32569; Robert V. Frierson, Jr., 219 Carmel Dr. #37, Fort Walton Beach, Fla. 32547; Jay L. Reed, 1015 Silcox Branch Cir., Oviedo, Fla. 32765

[21] Appl. No.: 660,714

[22] Filed: Feb. 25, 1991

[51] Int. Cl.[5] ..... H01J 29/48

[52] U.S. Cl. ..... 315/111.81; 315/111.01; 250/427; 250/492.3

[58] Field of Search ..... 315/111.01, 111.81, 315/111.91, 170, 173, 174; 313/230, 231.01; 250/423 R, 427, 492.3; 361/230, 231, 235

[56] References Cited

U.S. PATENT DOCUMENTS

| | | | |
|---|---|---|---|
| 2,939,086 | 5/1960 | Westendorp | 328/233 |
| 3,223,885 | 12/1965 | Stauffer | 315/111.81 |
| 3,414,702 | 12/1968 | Stauffer | 315/111.81 X |
| 3,450,996 | 6/1969 | Abramyan et al. | 328/233 |
| 3,518,484 | 6/1970 | Maskell | 315/111.81 |
| 4,107,507 | 8/1978 | Schultz et al. | 315/111.01 X |
| 4,240,005 | 12/1980 | Keller | 313/231 |
| 4,422,013 | 12/1983 | Turchi et al. | 315/111.81 |
| 4,426,597 | 1/1984 | Denoyer et al. | 313/231.41 |
| 4,931,700 | 6/1990 | Reed | 313/230 X |
| 5,008,594 | 4/1991 | Swanson et al. | 315/111.81 |

OTHER PUBLICATIONS

Winterberg, "The Potential of Electric Cloud. . . " Zeit. fur Met., vol. 25, No. 3, pp. 181-183, (1975).

*Primary Examiner*—Eugene R. LaRoche
*Assistant Examiner*—Do Hyum Yoo

[57] ABSTRACT

A generator for producing nonvacuum electron beam, and discharging electric energy to grounded targets. The generator includes a pulsed electron beam accelerator utilizing a Tesla transformer, obtaining its earth connection by the displacement current of an isolation capacitor, driving a cold cathode electron gun with a gasdynamic window to create an electrically conductive ionized channel in the free atmosphere. The generator includes a variable impedance source of high voltage direct current, connected across the isolation capacitor, providing a sustained potential difference between the cathode of the electron gun and the grounded target. The potential difference produces a conduction current and heat in the ionized channel.

7 Claims, 18 Drawing Sheets

```
      program strap
c
c     ver 5.00  1/16/91;  fortran version
c
c     this program calculates the gain, coupling coefficient, mutual inductance,
c     primary inductance, and secondary inductance of a spiral wound strip
c     tesla transformer. the primary is a single turn strip; the secondary
c     multiple turn. all units in mks.
c-----------------------------------------------------------------------------
c     input variable definitions
c-----------------------------------------------------------------------------
c     n          = number of turns in secondary.
c     a          = inner radius of secondary.
c     aprime     = outer radius of secondary.
c     b          = radius of primary.
c     s          = turn spacing in secondary (pitch).
c     ho         = width of primary
c     hs         = width of secondary
c     t          = strip thickness
c-----------------------------------------------------------------------------
c     subroutine definitions
c-----------------------------------------------------------------------------
c     datin      - input data
c     mutual     - calculate mutual inductance between secondary and primary
c     inta       - calculate integrand; called from subroutine mutual
c     primary    - calculate primary self inductance
c     secondary1 - calculate secondary self inductance - use trapezoidal
c                  rule for double integration
c     secondary2 - calculate secondary self inductance - use imsl double
c                  integration routine, executes faster than secondary1
c     fcall      - evaluate integrand called from secondary1 or imsl
c     fung       - evaluate integrand in fcall
c     gg         - evaluate lower limit of integral; called from imsl
c     hh         - evaluate upper limit of integral; called from imsl
c     dt2odq     - imsl routine to perform integral; called from
c                  secondary2
c-----------------------------------------------------------------------------
c     sample input file
c-----------------------------------------------------------------------------
c     190.         "n = number of turns"
c     0.127        "a = secondary inner build radius (all units meters)"
c     0.4287       "aprime = secondary outer build radius"
c     0.4487       "b = primary radius"
c     0.001588     "s = turn spacing"
c     0.1524       "ho = width primary"
c     0.1524       "hs = width secondary"
c     0.000127     "t = thickness of strip"
c-----------------------------------------------------------------------------
c     sample output file for sample input file
c-----------------------------------------------------------------------------
c     Transformer Geometry
c
c     Primary
c     Radius          = 0.448700          Width           = 0.152400
c
c     Secondary
c     Inner Radius    = 0.127000          Outer Radius    = 0.428700
c     Turn Spacing    = 0.001588          Strip Thickness = 0.000127
c     Number of Turns=    190.00          Strip Width     = 0.152400
```

Fig. 6A

```
c     mutual inductance     =    89.746 uh
c     primary inductance    =     1.499 uh
c     secondary inductance = 14852.793 uh
c     coupling coefficient =    0.6014
c     gain                  =    99.526
c-----------------------------------------------------------------------
      implicit real*8 (a-h,l-z)
      character*2  udmp
      call datin(n,a,aprime,b,s,ho,hs,t,udmp)
      call mutual(n,a,aprime,b,s,ho,hs,m)
      call primary(b,ho,lp)
c
c*****if imsl library exists, then set imsl=1; if not then set imsl = 0
c*****imsl solution is faster and should be used if possible
      imsl = 1
        if(imsl.eq.0) then
          call secondary1(n,a,aprime,s,hs,t,ls,udmp)
        elseif (imsl.eq.1) then
          call secondary2(n,a,aprime,s,hs,t,ls)
        endif
c
c*****calculate gain and coupling coefficient
      if((ls.gt.0.).and.(lp.gt.0.)) then
         g  = dsqrt(ls/lp)
         ak = m/dsqrt(lp*ls)
      else
         g  = 0.
         ak = 0.
      end if
c
c*****output results
      write(*,10) m*1.e6, lp*1.e6, ls*1.e6, ak, g
      write(9,10) m*1.e6, lp*1.e6, ls*1.e6, ak, g
 10   format(t5,'mutual inductance     = ',f9.3,' uh',/,t5,
     1'primary inductance    = ',f9.3,' uh',/,t5,
     2'secondary inductance = ',f9.3,' uh',/,t5,
     3'coupling coefficient = ',f9.4,/,t5,'gain',t26,'=',f10.3)
c
      stop
      end
c-----------------------------------------------------------------------
      subroutine datin(n,a,aprime,b,s,ho,hs,t,udmp)
c-----------------------------------------------------------------------
c*****subroutine to read input data, open output file
c
      implicit real*8 (a-h,l-z)
      character*20 name
      character*2  udmp
c
c*****get input file name
c
      write(*,*) ' enter datin'
      write(*,2000)
 2000 format(//,' Enter input file name (.inp) - ')
      read(*,2001) name
 2001 format(a)
c
c*****use the .DMP file to continue an interrupted calculation in secondary1
c*****or start calculation from scratch
```

Fig. 6B

```
c
      write(*,2002)
 2002 format(//,' Use .DMP file as input (Y/N) - ')
      read(*,2001) udmp
c
      write(*,2003)' Executing - Stand by...'
 2003 format(//,a,/)
c
c*****open and read the input file
c
      open(5,file=name(1:len(name))//'.inp',status='old')
      read(5,10) n
      read(5,10) a
      read(5,10) aprime
      read(5,10) b
      read(5,10) s
      read(5,10) ho
      read(5,10) hs
      read(5,10) t
      close(unit=5)
c
c*****open the output file and write configuration for this run
c
      open (9,file=name(1:len(name))//'.out',status='new')
      write(9,20) b,ho,a,aprime,s,t,n,hs
 10   format(f7.0)
 20   format(t5,'Transformer Geometry',//,t5,'Primary',/,t5,
     1'Radius',t20,'=',f9.6,t40,'Width',t56,'=',f9.6,//,t5,'Secondary'
     2,/,t5,'Inner Radius',t20,'=',f9.6,t40,'Outer Radius',t56,'=',f9.6
     3,/,t5,'Turn Spacing',t20,'=',f9.6,t40,'Strip Thickness',t56,'=',
     4f9.6,/,t5,'Number of Turns',t20,'= ',f9.2,t40,'Strip Width',t56,'=',
     5f9.6)
c
c*****return to the calling routine
c
      return
      end
c-----------------------------------------------------------------------
      subroutine mutual(n,a,aprime,b,s,ho,hs,m)
c-----------------------------------------------------------------------
c
c     Equation for Mutual Inductance
c
c
c
c     M = (b μo / (s ho hs)) ∫0^π Ψ(α) cos(α) dα
c
c
c     define,
c
c
c     δ = (hs - ho)/2 ;        h = (hs + ho)/2
c
c
c
c
c     P(α) = √(A^2 + b^2 + δ^2 - 2 A b cos(α))
c
```

Fig. 6C c $$Q(\alpha) = \sqrt{A^2 + b^2 + h^2 - 2\,A\,b\cos(\alpha)}$$

then, $$\begin{aligned}
\Psi(\alpha) = \Bigg\{ & \frac{\delta}{2}\left(A^2 - b^2\cos(2\alpha)\right)\cdot\ln\left(\frac{P-\delta}{P+\delta}\right) - \delta^2 P \\
& + \frac{h}{2}\left(A^2 - b^2\cos(2\alpha)\right)\cdot\ln\left(\frac{Q+h}{Q-h}\right) + h^2 Q \\
& + \frac{2}{3}\left(A^2 + b^2 + \delta^2 - 2\,A\,b\cos(\alpha)\right)^{3/2} \\
& - \frac{2}{3}\left(A^2 + b^2 + h^2 - 2\,A\,b\cos(\alpha)\right)^{3/2} \\
& + b^2\sin(2\alpha)\,\delta\,\tan^{-1}\left(\frac{(A - b\cos(\alpha))\,\delta}{b\sin(\alpha)\,P}\right) \\
& - b^2\sin(2\alpha)\,h\,\tan^{-1}\left(\frac{(A - b\cos(\alpha))\,h}{b\sin(\alpha)\,Q}\right) \\
& + b\cos(\alpha)\,(A - b\cos(\alpha))\,P - b\cos(\alpha)\,(A - b\cos(\alpha))\,Q \\
& + b\cos(\alpha)\,(b^2\sin^2(\alpha) - \delta^2)\cdot\ln(A - b\cos(\alpha) + P) \\
& - b\cos(\alpha)\,(b^2\sin^2(\alpha) - h^2)\cdot\ln(A - b\cos(\alpha) + Q) \Bigg\}\Bigg|_{A=a}^{A=a'}
\end{aligned}$$

c

```
c*****subroutine to calculate mutual inductance
c
      implicit real*8(a-h, l-z)
      write(*,*) ' enter mutual'
      delta = (hs-ho)/2.
      if (delta.eq.0.) delta = 1.e-10
      mu    = 1.257e-6
      pi    = 3.14159265359
      h     = (hs+ho)/2.
      m     = 0.
      int   = 2000
c
      do i = 0,int
         alpha = dble(i)*pi/dble(int)
         call inta(a,b,s,delta,h,alpha,t1)
         call inta(aprime,b,s,delta,h,alpha,t2)
         m = m + (t2-t1) * dcos(alpha) * pi / dble(int)
 10   end do
c
      m = m * b * mu / (s*ho*hs)
c
c*****return to calling routine
c
      return
```

Fig. 6D

```
      end
c-----------------------------------------------------------------------
      subroutine inta(atemp,b,s,delta,h,alpha,t)
c-----------------------------------------------------------------------
c*****subroutine to compute intagrand for mutual calculation
c*****called from subroutine mutual
c
      implicit real*8 (a-h, l-z)
      p  = dsqrt(atemp**2+b**2+delta**2-2.*atemp*b*dcos(alpha))
      q  = dsqrt(atemp**2+b**2+h**2-2.*atemp*b*dcos(alpha))
      r1 = (p - delta)/(p + delta)
      r2 = (q + h)/(q - h)
      t  = 0.
c
      if (r1.gt.0.) then
        t = delta/2. * (atemp**2 - b**2 * dcos(2.*alpha)) * dlog(r1)
      endif
      t = t - delta**2 * p
      if (r2.gt.0.) then
        t = t + h/2. * (atemp**2 - b**2 * dcos(2. * alpha)) * dlog(r2)
      endif
      t = t + h**2 * q
      t = t+2./3.*
     .    (atemp**2+b**2+delta**2-2.*atemp*b*dcos(alpha))**(3./2.)
      t = t-2./3.*
     .    (atemp**2+b**2+h**2-2.*atemp*b*dcos(alpha))**(3./2.)
      if (alpha.ne.0.) then
        t = t+b**2*dsin(2.*alpha)*delta*datan((atemp-b*dcos(alpha))*
     .      delta/(b*dsin(alpha)*p)) - b**2*dsin(2.*alpha)*h*
     .      datan((atemp-b*dcos(alpha))*h/(b*dsin(alpha)*q))
      endif
      t = t + b * dcos(alpha) * (atemp - b * dcos(alpha)) * p
      if ((atemp - b * dcos(alpha) + p).gt.0.) then
        t = t + b*dcos(alpha)*(b**2* (dsin(alpha)**2) - delta**2) *
     .      dlog(atemp - b*dcos(alpha) +p)
      endif
      t = t - b * dcos(alpha) * (atemp - b * dcos(alpha)) * q
      if ((atemp - b * dcos(alpha) +q).ne.0.) then
        t = t - b * dcos(alpha) * (b**2 * (dsin(alpha)**2) - h**2)
     .      * dlog(atemp - b * dcos(alpha) + q)
      endif
c
c*****return to subroutine mutual
c
      return
      end
c-----------------------------------------------------------------------
      subroutine primary(b,ho,lp)
c-----------------------------------------------------------------------
c     calculate primary turn self-inductance
c     reference: fredrick grover, "inductance calculations", 1946, p. 143
c
      implicit real*8 (a-h, l-z)
      write(*,*)' enter primary'
      pi = 3.14159265359
      lp = .004 * pi * b * 100 * (dlog(8. * b / ho) - .5)
      lp = lp * 1.e-6
c
c*****return to calling routine
```

Fig. 6E

```
c
      return
      end
c-----------------------------------------------------------------------
      subroutine secondary1(n,ro,r1,sigma,h,eps,ls,udmp)
c-----------------------------------------------------------------------
c*****calculate self inductance of secondary turn; use trapezoidal rule
c     to perform double integral
c
c
c
```

$$- A \left[ \frac{3c^2 - 2}{10} A^4 + \frac{12c^2 + 7}{10} c\, x\, y\, A^2 - \frac{6}{5} c^2 s^2 x^2 y^2 \right]$$

$$+ \frac{1}{20} \frac{\gamma^4}{s^3} \left[ s \sqrt{w} - c\, \gamma \tan^{-1}\left( \frac{s\, \gamma \sqrt{w}}{x\, y\, s^2 + c\gamma^2} \right) \right] \Bigg\} \Bigg|_{x=u-\frac{\delta}{2}}^{x=u+\frac{\delta}{2}} \Bigg|_{y=v-\frac{\delta}{2}}^{y=v+\frac{\delta}{2}}$$

```
c
      implicit real*8 (a-h, l-z)
      common/data/ gamma,delta,alpha,beta
      character*2  udmp
      write(*,*)' Enter secondary1'
      pi    = 3.14159265359
      mu    = pi * 4.e-7
      alpha = 2.*pi*ro/sigma
      beta  = 2.*pi*r1/sigma
      delta = 2.*pi*eps/sigma
      gamma = 2.*pi*h/sigma
      nstep = 10 * int(13.*(r1-ro)/sigma)
      du    = (beta - alpha) / nstep
      dv    = du
      u     = alpha
      v     = alpha
      z     = 0.
      d2    = delta / 2.
      ls    = 0.
      ist   = 1
c
c*****read intermediate input file if calculation was interrupted
        if(udmp(1:1).eq.'Y'.or.
     .     udmp(1:1).eq.'y') then
           open(11,file='strap.dmp',status='old')
           read(11,*) ist,ls,u
           close(11)
        end if
c
      do 30 i = ist, nstep
c
         do 20 j = 1, int(nstep*(u-alpha)/(beta-alpha))
c
            lstemp = fcall(u, v)
            if(u.eq.alpha.or.
     .         u.eq.beta.or.
     .         v.eq.alpha.or.
     .         v.eq.u)then lstemp = lstemp/2.
            ls  = ls + lstemp*dv*du
            v   = v + dv
  20     end do
c
         v = alpha
         u = u + du
c
c*****write out intermediate loop values to dump file
c
21       open (11,file='strap.dmp',iostat=istat,err=22,status='unknown')
22       if(istat.eq.30) then
```

Fig. 6G

```
            goto 21
         elseif(istat.ne.0) then
            write(*,*)'Execution halted - could not open dump file'
            stop
         end if
         write(11,*) i+1,ls,u,nstep
         close(11)
c
  30  end do
c
      ls = ls * mu*h/(3.*pi*gamma**3*delta**2)
c
c**** return to the calling routine
c
      return
      end
c-----------------------------------------------------------------------
      subroutine secondary2(n,ro,r1,sigma,h,eps,ls)
c-----------------------------------------------------------------------
c*****calculate self inductance of secondary turn; use gauss-kronrod
c     quadrature routine in imsl library to evaluate double integral
c
      implicit real*8 (a-h, l-z)
      external fcall,fung,gg,hh
      common/data/ gamma,delta,alpha,beta
c
c*****dimension work space for imsl
c
      dimension alist(500),blist(500),rlist(500),elist(500),iord(500),
     .          wk(2000),iwk(500)
c
      write(*,*)' Enter secondary2'
      pi    = 3.14159265359
      mu    = pi * 4.e-7
      alpha = 2.*pi*ro/sigma
      beta  = 2.*pi*r1/sigma
      delta = 2.*pi*eps/sigma
      gamma = 2.*pi*h/sigma
      ist   = 1
c
      call dt2odq(fcall,alpha,beta,gg,hh,.1,.1,6,ls,lserr,
     .            500,neval,nsubin,alist,blist,rlist,elist,iord,wk,iwk)
c
      ls = ls * mu*h/(3.*pi*gamma**3*delta**2)
c
c*****return to the calling routine
c
      return
      end
c-----------------------------------------------------------------------
      function fcall(u,v)
c-----------------------------------------------------------------------
c*****called from imsl integration routine or secondary1 integration
c     to evaluate integrand.
c
      implicit real*8 (a-h, l-z)
      common/data/ gamma,delta,alpha,beta
      d2    = delta/2.
      bigg  = fung( u+d2, v+d2, gamma, u, v)-
```

Fig. 6H

```
     .        fung( u-d2, v+d2, gamma, u, v)-
     .        fung( u+d2, v-d2, gamma, u, v)+
     .        fung( u-d2, v-d2, gamma, u, v)
      phi   = datan((u - v)/(u * v + 1.))
      fcall = dcos(u - v + phi) * bigg
      return
      end
c-----------------------------------------------------------------------
      function fung(x,y,gamma,u,v)
c-----------------------------------------------------------------------
c*****evaluate integrand for function fcall
c
      implicit real*8 (a-h, l-z)
      c = dcos(u - v)
      s = dsin(u - v)
      a = dsqrt( x**2 + y**2 - 2.*c*x*y)
      w = gamma**2 + a**2
      sqtw = dsqrt(w)
c
      if(u .eq. v) then
      g1 = c*x**3/2. * (gamma**2 - 0.6*s**2*x**2) * dlog(sqtw + y
     .    -c*x) + c*y**3/2. * (gamma**2 - 0.6*s**2*y**2) *
     .    dlog(sqtw + x - c*y)
      g2 = 0.
          if(x .eq. y) then
          g3 = 0.
          else
          g3 = 0.375*gamma*(2.*x**2*y**2 + (s**2 - c**2) *
     .         (x**4 + y**4)) * dlog((sqtw+gamma)/a)
          end if
      g4 = 0.
      g5 = 0.
      g6 = sqtw*(0.225*gamma**2*(x**2+y**2) + (3.*c**2-2.)/10.*a**4 +
     .     (12.*c**2-7.)/10.*c*x*y*a**2 - 1.2*c**2*s**2*x**2*y**2)
      g7 = a*((3.*c**2-2.)/10.*a**4 + (12.*c**2-7.)/10.*c*x*y*a**2 -
     .     1.2*c**2*s**2*x**2*y**2)
      g8 = sqtw*gamma**2/60. * (gamma**2 + x**2 + y**2 + x*y)
c
      else
c
      g1 = c*x**3/2. * (gamma**2 - 0.6*s**2*x**2) * dlog(sqtw + y
     .    -c*x) + c*y**3/2. * (gamma**2 - 0.6*s**2*y**2) *
     .    dlog(sqtw + x - c*y)
      g2 = 0.3*c*s**2*(x**5 * dlog(a+y-c*x) + y**5 * dlog(a+x-c*y))
      g3 = 0.375*gamma*(2.*x**2*y**2 + (s**2 - c**2) *
     .     (x**4 + y**4)) * dlog((sqtw+gamma)/a)
      g4 = -0.75*gamma*c*s*x**4 * datan(gamma*(y-c*x)/(s*x*sqtw))
      g5 = -0.75*gamma*c*s*y**4 * datan(gamma*(x-c*y)/(s*y*sqtw))
      g6 = sqtw*(0.225*gamma**2*(x**2+y**2) + (3.*c**2-2.)/10.*a**4 +
     .     (12.*c**2-7.)/10.*c*x*y*a**2 - 1.2*c**2*s**2*x**2*y**2)
      g7 = a*((3.*c**2-2.)/10.*a**4 + (12.*c**2-7.)/10.*c*x*y*a**2 -
     .     1.2*c**2*s**2*x**2*y**2)
      g8 = 0.05*gamma**4/s**3 * (s*sqtw - c*gamma*datan(s*gamma*sqtw/
     .     (x*y*s**2 + c*gamma**2)))
c
      end if
      fung  = g1+g2+g3+g4+g5+g6-g7+g8
c
c*****return to fcall
```

Fig. 61

```
c
      return
      end
c-----------------------------------------------------------------------
      function gg(u)
c-----------------------------------------------------------------------
c*****evaluate lower limit of integral; called from imsl
c
      implicit real*8 (a-h, l-z)
      common/data/ gamma,delta,alpha,beta
      gg = alpha
      return
      end
c-----------------------------------------------------------------------
      function hh(u)
c-----------------------------------------------------------------------
c*****evaluate upper limit of integral; called from imsl
c
      implicit real*8 (a-h, l-z)
      common/data/ gamma,delta,alpha,beta
      hh = u
      return
      end
```

Fig. 6J

DIRECTED ELECTRIC DISCHARGE GENERATOR

BACKGROUND OF THE INVENTION

1. Field of the Invention

The present invention radiates electron-beam into the free atmosphere and discharges electric energy to grounded targets.

2. Description of the Prior Art

Nonvacuum electron beam has applications including metallurgical heat engineering and directed energy concepts. Energetic beams are preferred for projection into the atmosphere, and similar high-pressure gaseous media, due to their penetrating depth and spatial stability. In addition, large beam current is desired as the resulting plasma focussing action radially confines the beam, and reduces dispersion. The approximate range R, in centimeters, at sea level, of an electron whose energy E, in units of MeV, lying between two and one-half and twenty million electron volts, is given by Feather's rule as $$R = 543(E) - 106.$$

Thus, an electron whose energy is 5 MeV penetrates a maximum of some twenty-five meters into the atmosphere as its energy is expended ionizing the air.

The electron range is inversely porportional to the frequency of the ionizing interactions, and so greater range is obtained in media of lower density. By way of example, the electron's range is approximately doubled by reducing the density of the absorbing media by a factor of one-half.

A low density ionized channel is formed by repetitively discharging electron beam into the atmosphere. Each beam penetrates further owing to the rarefraction provided by the heating of its predecessors. This directed energy technique is known in the art as hole boring. Depending upon beam power and repetition rate, beam ranges can be obtained that exceed, by manyfold, the range of a single pulsed beam.

A discussion of hole boring is presented in F. Winterberg, "The Potential of Electric Cloud Modification by Intense Relativistic Electron Beams," *Zeitschchrift fur Meteorologie*, Vol. 25, No. 3, pp. 180–191, (1973). Winterberg suggests a pulse power in combination with a repetition rate to produce a grand maximum electron beam range in the atmosphere. The suggested repetition rate is one million beams per second. The rate is high because the lifetime of long channels is short, due to heat loss from their large surface area. The next beam must be discharged into the channel before appreciable density is recovered due to cooling.

Repetition rates such as a million beams per second are a thousandfold beyond current art in high-voltage switch technology. A technique is needed to improve the economy of beam energy transport, thereby increasing electron beam range, using presently obtainable pulse repetition rates such as a hundred per second.

SUMMARY OF THE INVENTION

The present invention is a directed electric discharge generator that includes a pulsed electron beam accelerator to create an electrically conductive ionized channel in the open air, between the electron emitter of the accelerator system and the grounded target.

The generator includes an extra power supply, integrated with the accelerator system, to provide a sustained discharge of electric energy by conduction through the ionized channel to the grounded target.

The preferred electron gun employed in the accelerator system is described in Jay L. Reed, "Electron Beam Gun," U.S. Pat. No. 4,931,700 (June 5, 1990). The gun's vacuum to air interface is obtained by the gasdynamic action of a cold supersonic jet about the cathode emitter. The emitted electrons freely pass through the gasdynamic window into the atmosphere, without encountering the material encumbrance of a metallic foil vacuum to air interface.

The preferred power supply to drive the electron gun is the Tesla transformer, as it produces multi-megavolt pulses of very high power. Pulse power on the order of tens of megawatts is common in the art. The pulse repetition rate is twice the frequency of the supply mains, and is limited only by the deionization time of its single spark-gap switch. When a high-voltage pulse is applied by the Tesla transformer, driving the gun's cathode to a large negative potential, the electric field at the cathode face becomes so great that cold-field emission of electrons occurs. The electrons are released normal to the face of the cathode and are accelerated through the evacuated region of the gun barrel by the electric field of the cathode. The electrons pass through the gasdynamic window, into the open atmosphere, to the grounded target.

When a rapid series of beams is released by the accelerator system, a spatially stable ionized channel is created in the atmosphere between the cathode and the grounded target.

The earth connection of the secondary winding of the Tesla-transformer is made through an isolation capacitor. The extra power supply is connected across the isolation capacitor. Additional electric energy flows through the ionized channel, by conduction, due to the potential difference established between the cathode and the grounded target by the extra supply. The additional energy heats the ionized channel and lowers its density.

It is therefore an object of the invention to provide an accelerator system that forms an ionized channel in the open air which is heated and rarefied by a superimposed power source, thereby increasing the efficiency of electron beam energy transport.

This and other objects and advantages of the invention will become apparent from the following detailed description when read in conjunction with the drawings.

BRIEF DESCRIPTION OF THE DRAWINGS

FIG. 6A–J is the computer source code that obtains spiral strip transformers;

DETAILED DESCRIPTION OF THE PREFERRED EMBODIMENT

Figure 1:
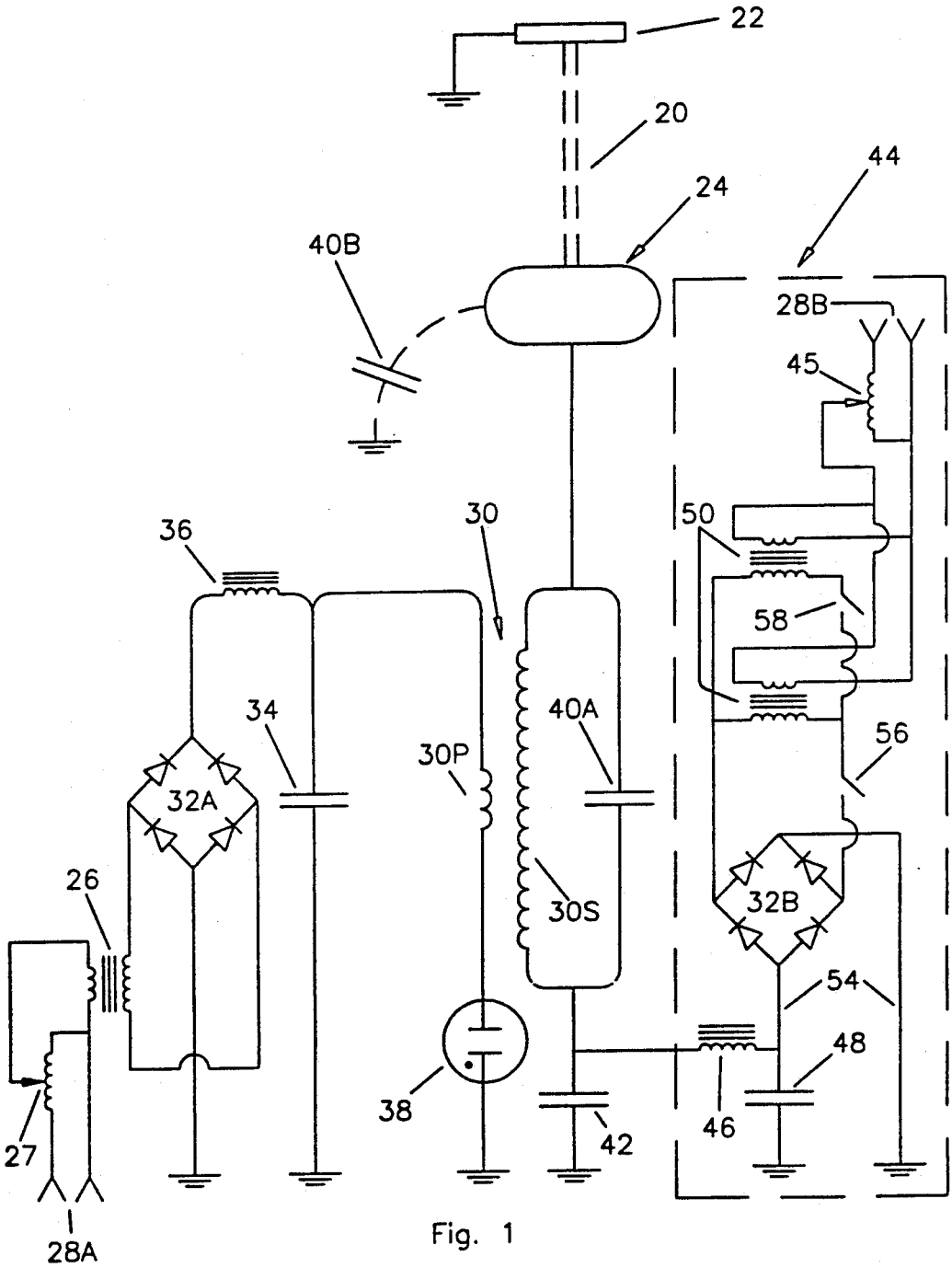
FIG. 1 is an electrical diagram of the generator.

The directed electric discharge generator of the invention is indicated schematically in FIG. 1 in which electron beam 20 impinges upon grounded target 22. As will be understood, electron gun 24 may be excited by any pulse transformer of sufficiently high voltage. However, the preferred source is a Tesla transformer as shown schematically in FIG. 1. A high-voltage supply transformer 26, powered by the 60 cycle commercial mains 28A, with an output voltage of 15 to 80 kilovolts is suitable for exciting Tesla transformer 30 and electron gun 24. The output of transformer 26 is controlled by autotransformer 27 and rectified by full wave bridge 32A. Tesla transformer 30 includes a small primary inductance 30P magnetically coupled to a large secondary inductance 30S. The ohmic resistance and eddy current loss of the transformer windings are as low as practical. The value of the mutual inductance is selected along with the values of the primary capacitance and winding inductances to produce operability as is known in the art.

The fully rectified and unfiltered current from transformer 26 charges primary capacitor 34 via the charging inductor 36 which isolates oscillations in the Tesla transformer from the charging equipment.

Transformer 26 is impedance matched to capacitor 34 at the supply mains frequency of 60 Hertz, which is known in the art as one-half cycle a.c. resonant charging. The selection, adjustment of circuit parameters, and impedance matching is presented in Jay L. Reed, "Greater voltage gain for Tesla transformer accelerators," *Review of Scientific Instruments*, Vol. 59, No. 10, pp. 2300–2301, (1988).

Switch 38 is adjusted to conduct at the voltage obtained across capacitor 34 at full charge. The preferred switch type is the pressurized gasdynamic spark-gap which is familiar to pulse power engineers. This type of switch, with sulfur hexaflouride as the insulating gas, suitably performs hundreds of distinct commutations a second.

When capacitor 34 is fully charged, switch 38 commutates the energy into inductance 30P. The Tesla transformer 30 executes an oscillation and transfers the energy of capacitor 34 into the relatively small capacity of the secondary circuit. The capacity of the secondary circuit consists of the distributed capacity 40A of the secondary inductance in parallel with the electrostatic capacity 40B of the electron gun. The resulting voltage gain is substantially equal to the square root of the quotient of the primary capacitance divided by the secondary capacitance. Voltage gains of 15 to 40 are commonly achieved in prior art.

Figure 2:
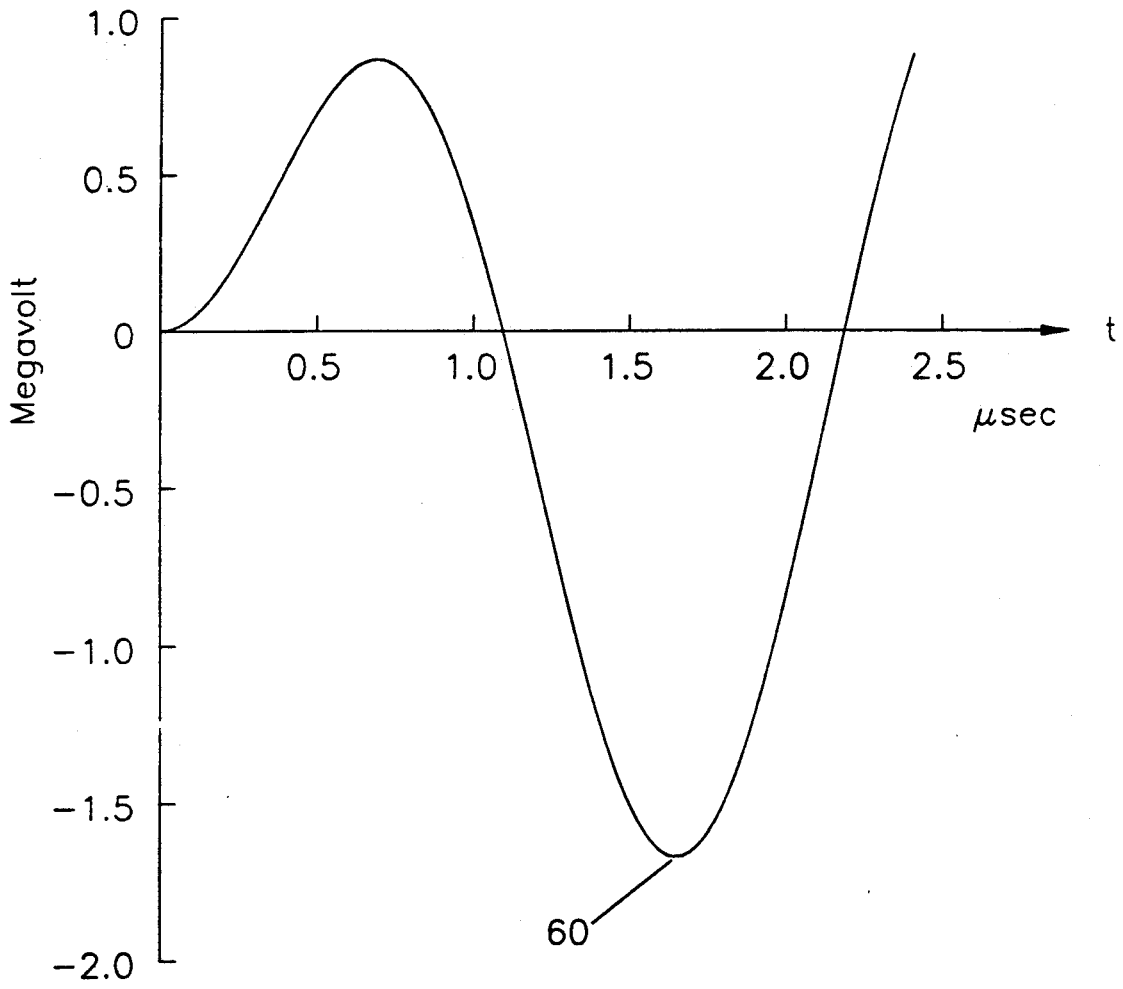
FIG. 2 is a typical output voltage history of the Tesla transformer of FIG. 1.

The peak voltage applied to the electron gun is the product of the voltage gain and the voltage on capacitor 34 at the instant of commutation. For purposes of explanation, a high-voltage supply transformer rated at 15 kilovolts and a Tesla transformer with a voltage gain of 100., producing a 1.5 megavolt surge will be assumed to be applied to the gun. FIG. 2 shows a typical voltage history of such output surge. Near peak 60 of the negative going portion of the surge, cold-field emission will occur, and electron beam will be discharged to grounded target 22. As the primary capacitor is fully charged and discharged at twice the frequency of the commercial mains, the Tesla transformer accelerator system will emit 120 beams per second. Thus, the preferred power supply generates a sequence of high-power beams at a repetition rate controlled by the frequency of the supply mains.

The Tesla transformer's earth connection is made through the displacement current of capacitor 42, thereby isolating winding 30S from earth with respect to currents of low frequency. The oscillatory characteristics of the Tesla transformer remain unchanged regardless of the earth connection occurring by a conduction current or by the displacement current of the isolation capacitor.

FIG. 1 shows the extra power supply 44, supplied by commercial mains 28B, connected across isolation capacitor 42. The output voltage of power supply 44 is on the order of tens of kilovolts and is controlled by autotransformer 45. Power supply 44 is shown producing high-voltage direct current utilizing full-wave bridge rectifier 32B and a filter section consisting of inductor 46 and capacitor 48. Power supply 44 possesses sufficient current rating to produce an increase in the temperature of the ionized channel created by electron beam 20.

Maximum power transfer efficiency occurs when the impedance of power supply 44 matches the impedance of its load. A portion of the load impedance seen by the extra power supply is the impedance of the ionized channel created by beam 20. The impedance of the ionized channel will vary according to its operating conditions, and for this reason the impedance of power supply 44 must also be variable.

The variable impedance function is obtained by using a plurality of parallel wired high-voltage supply transformers, of identical ratio and impedance characteristics, that are switched in and out of the circuit to raise and lower the impedance of extra power supply 44. By way of example, and for one embodiment, two high-voltage high-current supply transformers, labeled 50 in FIG. 1, are shown communicating with bus 54 through respective switches 56 and 58. The impedance of power supply 44 is doubled or halved by switching transformer 50 on or off bus 54. An economical design will result based upon experience with the plasma operating condition for the particular application at hand.

Figure 3:
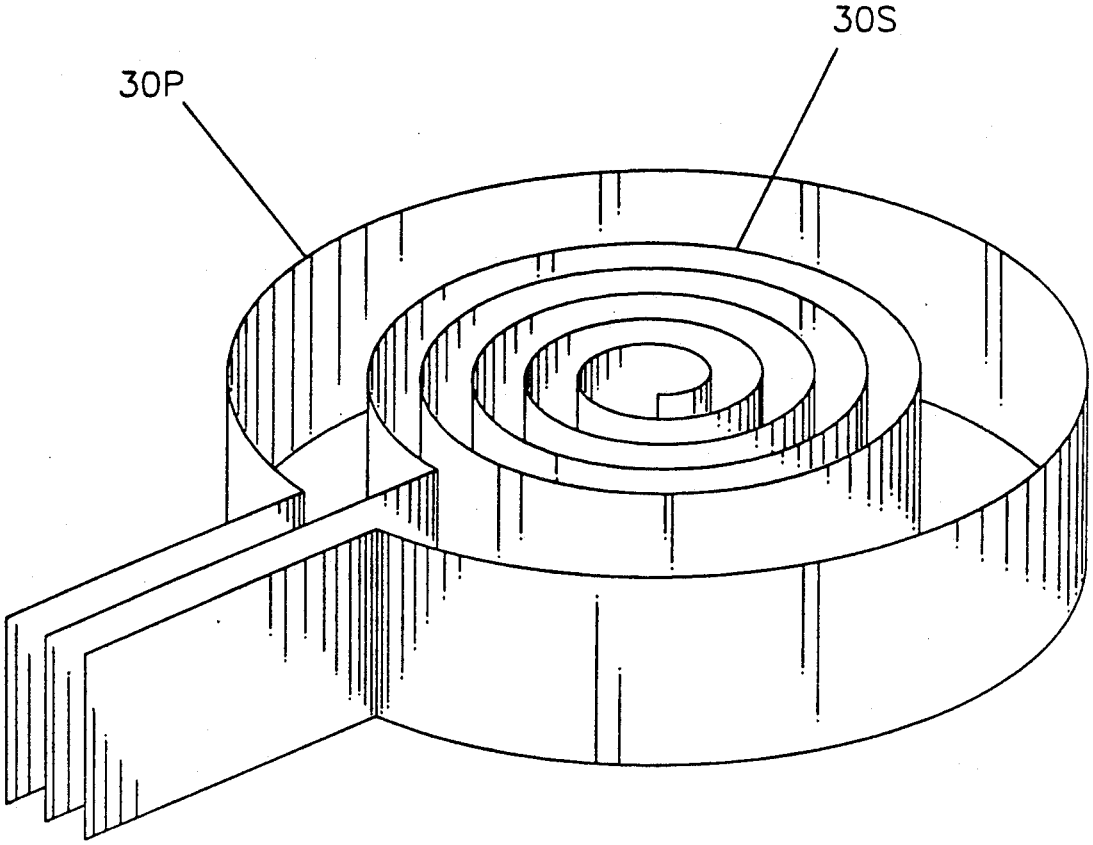
FIG. 3 is the preferred thin spiral strip winding topology of the Tesla transformer.

FIG. 3 shows the preferred winding topology of the Tesla transformer, known in the art as spiral strip. For purposes of explanation, the secondary inductance 30S is a spiral strip winding of 0.127 millimeter thick by 152 millimeter wide metallic strip. The primary inductance 30P is a single turn of 0.127 millimeter thick by 152 millimeter wide metallic strip.

The pitch, or turn spacing, of the spiral winding is defined as the sum of the strip thickness and the turn to turn insulation thickness. The aspect ratio of the spiral winding is defined as the quotient of the winding's width divided by its pitch. Spiral windings suitable for the present invention require large aspect ratios to obtain low ohmic resistance in combination with physical compactness.

Figure 4:
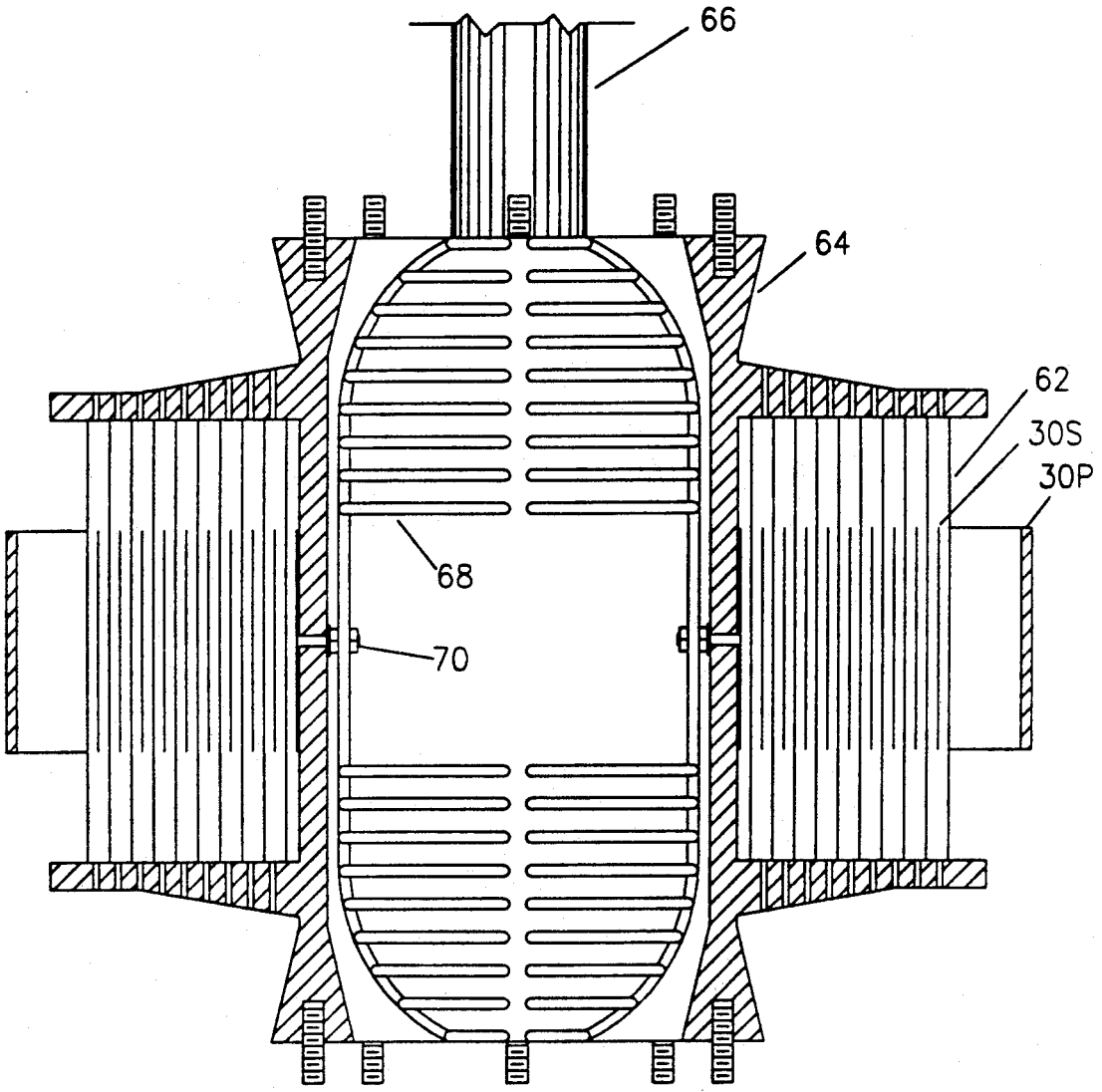
FIG. 4 is a view of the thin spiral strip winding topology with portions thereof in cross section.

FIG. 4 shows the preferred winding topology in cross-section. Secondary winding 30S is interleaved with a composite lamination 62 to obtain both the required turn spacing and dielectric strength. Lamination 62 consists of 300 millimeter wide insulating film of Kapton(R) in combination with a plurality of Mylar(R) films; both products of the E. I. DuPont De Nemours company. Winding 30S is fixed to lamination 62 by sparse and tiny patches of suitable cement. Winding 30S is supported upon a National Electrical Manufacturer's Association (N.E.M.A.) grade G-10 Glass Reinforced Epoxy bobbin 64, available from Accurate Plastics Incorporated of New York.

FIG. 4 shows the current of winding 30S brought out by an eddy-current free bus 66 in combination with the ring cage 68. Cage 68 attaches to end of winding 30S by fasteners 70. Bus 66 is comprised of individual wires emanating from uppermost segmented ring of cage 68.

The spiral strip winding is highly preferred for its uniquely low distributed capacity. Additionally, capacity 40A is reduced further by constructing spirals with small ratios of inside to outside diameter. Distributed capacity 40A stores energy and holds it unavailable for external work. This inefficiency is amplified when winding 30S is operated at extreme voltages as the energy stored increases by the square power of the voltage.

Although the implementation of spiral strip windings in the present invention is exceedingly desirable, their design is impractical for the following reasons. An expression for the mutual inductance of the winding topology does not exist in prior art. Furthermore, an exact expression for the self-inductance of spiral secondary winding 30S, of arbitrary geometry, does not exist in prior art. A limited expression for the self-inductance of a spiral strip is presented in F. W. Grover, *Inductance Calculations*, (D. Van Nostrand, New York, 1946), Chap. XVII. Grover's expression for self-inductance rapidly diverges for aspect ratios greater than four. The present invention contemplates the use of very wide windings, possessing aspect ratios on the order of hundreds or thousands, thereby passing the heavy current of power supply 44 with low ohmic loss. The lack of accurate design tools, not only forces the transformers to be constructed by experiment, but seriously impedes the development of the art.

In order to reduce the costly and laborious experimental work prior art designers construct transformers with high mutual inductance, and add to their primary and secondary circuits additional external tuning inductors to lower and obtain an effective mutual inductance of the desired value. This technique, while expedient, results in reduced efficiency as energy is dissipated and stored within the tuning inductors.

Figure 5:
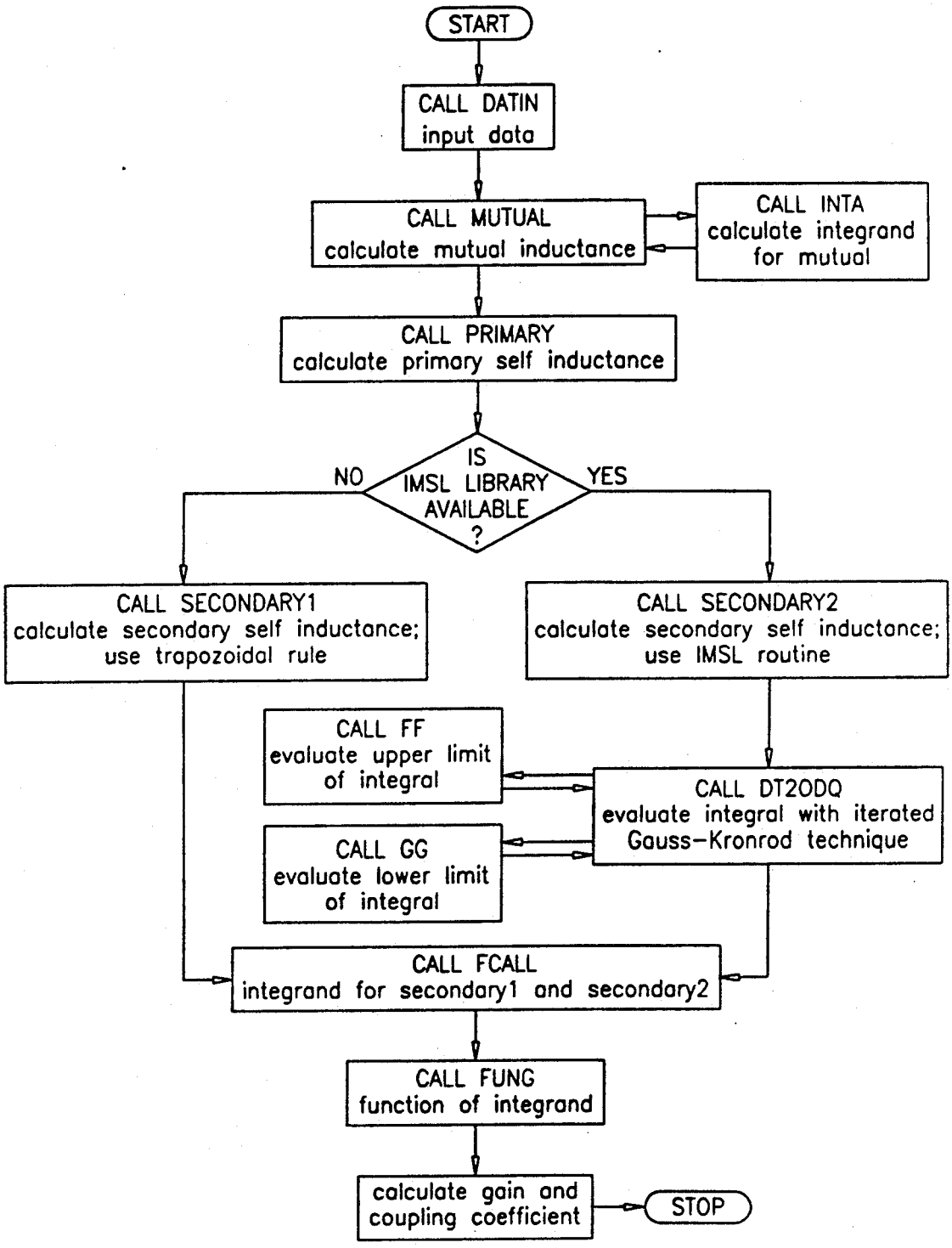
FIG. 5 is a high-level flow chart of the computer-aided method for obtaining spiral strip transformers.

FIG. 5 is a high-level flowchart of a computer-aided method, developed by us, to easily obtain spiral strip windings suitable for the present invention. The method allows the freedom to study the influence of the spiral strip winding parameters and accurately predict a proposed winding's performance. By this method high performance Tesla transformers, devoid of external tuning inductors, and possessing aspect ratios to satisfy the specific current carrying requirement under consideration, can be directly obtained without resorting to experiment.

FIG. 6 is the computer source code. The code contains a novel expression for the mutual inductance of the thin spiral strip winding topology of arbitrary geometry. The expression for the mutual inductance is exact for vanishingly thin windings. The code also contains a novel exact expression for the self-inductance of the spiral secondary winding 30S of arbitrary geometry. The numerical integration routine, DT20DQ, highly preferred for both computational speed and accuracy, is commercially available from IMSL company of Houston, Tex.

We have experimentally verified this new method on a variety of thin windings, including those possessing widths of one-third meter and aspect ratios greater than three thousand, and found prediction and measurement to compare within three and one-half percent. The bulk of this small error is due to the geometrical imprecisness of our windings.

The following example transformer winding was obtained by the method of FIG. 5. The magnetic coupling coefficient is defined as the quotient of the mutual inductance divided by the geometric mean of self-inductances 30P and 30S. The example winding possesses a coupling coefficient of three-fifths to obtain perfect energy transfer.

| EXAMPLE TRANSFORMER WINDING | |
|---|---|
| Primary winding: | mean radius = 0.4487 m |
| | strip width = 0.1524 m |
| | strip thickness = 0.000127 m |
| Secondary winding: | number of turns = 190. |
| | turn spacing = 0.00158 m |
| | inner radius = 0.1270 m |
| | outer radius = 0.4287 m |
| | strip width = 0.1524 m |
| | strip thickness = 0.000127 m |
| Magnetics: | primary inductance = 1.49 uH |
| | secondary inductance = 14852.79 uH |
| | mutual inductance = 89.74 uH |
| Performance: | voltage gain = 99.52 |
| | coupling coefficient = 0.6 |

The electrical efficiency and structural integrity of the generator is compromised when winding 30S suffers heating by the heavy current of power supply 44 in combination with the pulsating radio-frequency currents of Tesla-transformer 30. The present invention aims to remove heat from the windings and reduce the rate of heat generation by refrigerating the same in a liquid nitrogen bath. The electric conductivity of the windings is increased some sevenfold at liquid nitrogen temperature.

The bath is preferably under a hydrostatic pressure of 15 pounds per square inch gauge to increase dielectric strength and encourage calming. The winding wetting efficiency is increased, if required, by interleaving a polyamide mesh, such as wedding veil material, between the metallic strip and Kapton film.

In the prior art preventing electrical flashover within compact transformers was difficult. A successful insulation scheme for the spiral strip topology is presented in G. J. Rohwein, "Development of a 3 MV Pulse Transformer," Sandia Laboratory Report SAND79-0813. Rohwein's technique consists of an eddy-current free electric field conditioning structure in combination with insulating oil. The Tesla transformer of the present invention utilizes Rohwein's ring cages for electric field conditioning, but uses the pressurized nitrogen cryogen as the liquid dielectric.

Figure 7:
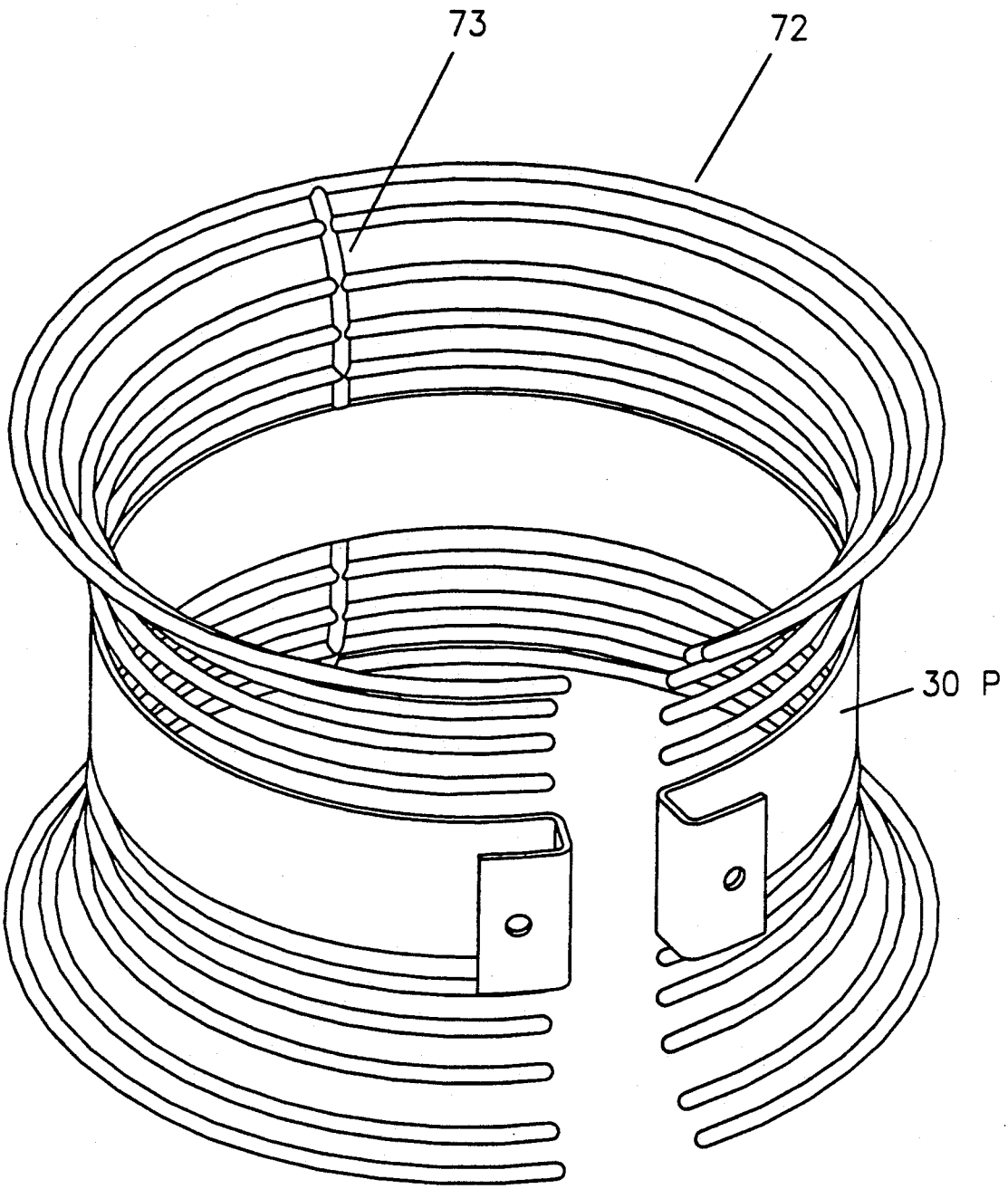
FIG. 7 is a view of the primary winding fitted with a ring cage.

FIG. 7 is a view of winding 30P fitted with electric field conditioning ring cage 72. Metallic strut 73 electrically attaches cage 72 to midpoint of winding 30P. FIG. 4 shows winding 30S fitted with companion ring cage 68. If winding 30S is wound deeply to its center, resulting in a small inside diameter, ring cage 68 is unnecessary and bus 66 directly attaches.

The pressurized high-purity liquid nitrogen furnishes liquid electrical insulation with dielectric strength near transformer oil. Additionally, the turn to turn dielectric strength of the Kapton and Mylar film insulated winding is enhanced.

Figure 8:
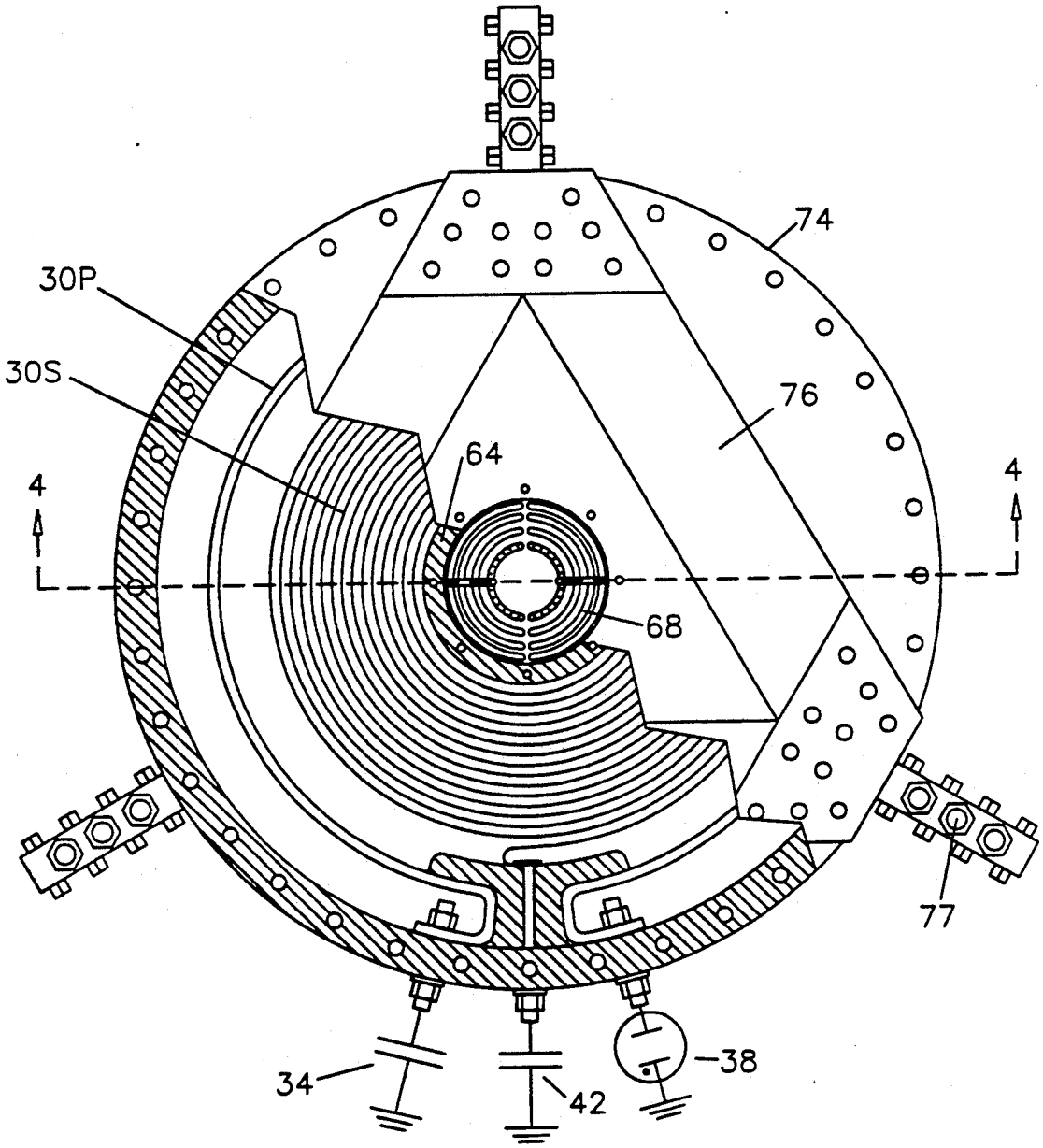
FIG. 8 is a plan view of the Tesla transformer mounted in a pressure vessel; and, FIG. 9 is a perspective view of the transformer driving the preferred electron gun with portions thereof cutaway.

FIG. 8 shows a cutaway plan view of the Tesla transformer mounted in a N.E.M.A. grade G-10 Glass Reinforced Epoxy pressure vessel 74. The external load bearing members 76 are Extren(R) fiberglass structural shapes, and mechanical fastners 77 are Fiberbolt(R); both of the Morrison Molded Fiber Glass Company of Bristol, Va. The surfaces of vessel 74 are sheathed with an electrically non-conductive cryogenic insulation such as polyurethane foam.

Figure 9:
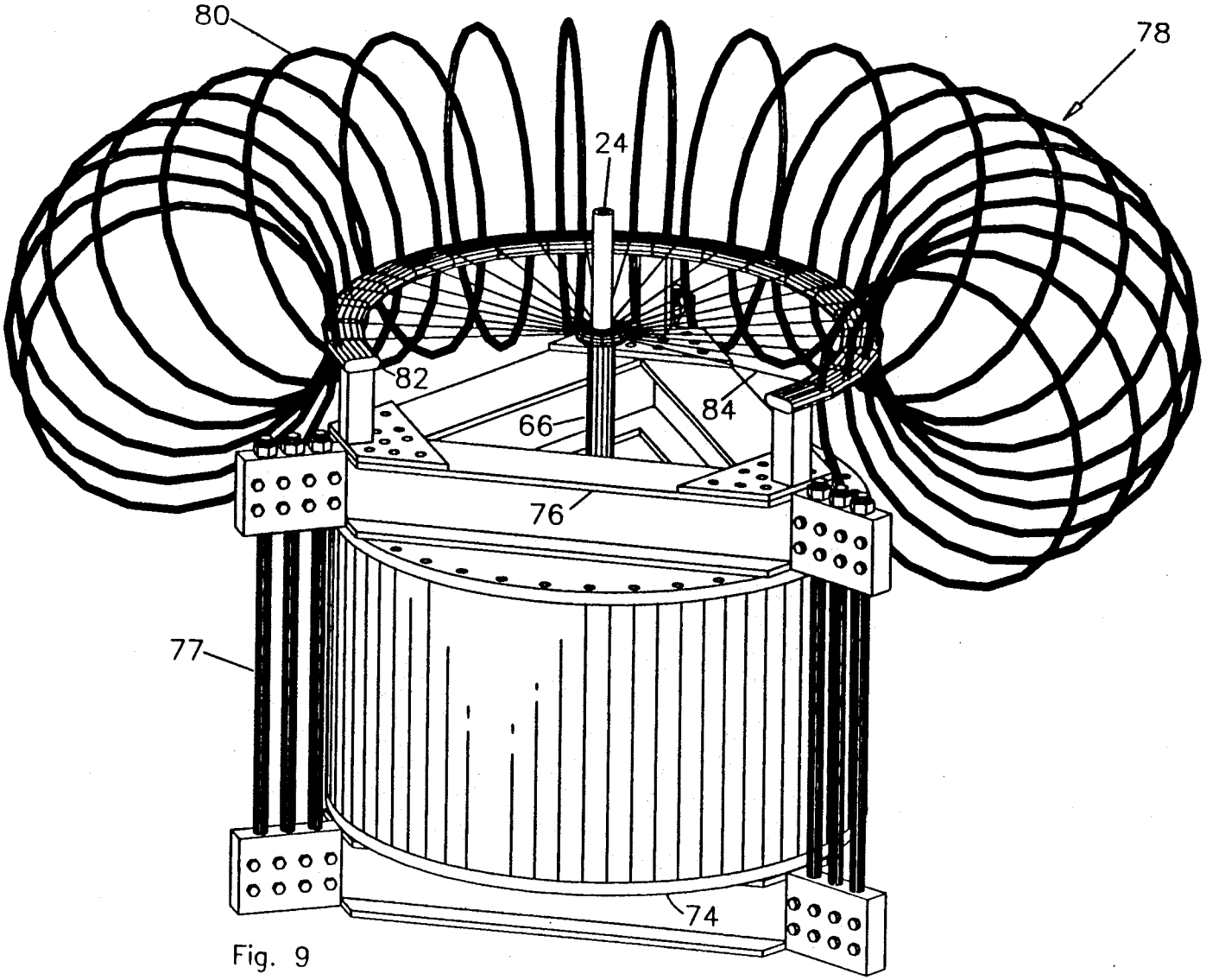

FIG. 9 is a perspective view of the Tesla transformer directly driving the preferred electron gun 24. Toric corona shield 78 of electron gun 24 is shown in cross-section. Shield 78 confines the high electric field to the emission surface of the cathode electrode of gun 24. Shield 78 is brought into close proximity of the Tesla transformer by utilizing an eddy-current free construction as will now be discussed. Shield 78 is comprised of metallic hoops 80 tangentially fastened to fiberglass ring 82. Hoops 80 are opened where they fasten to ring 82, thereby eliminating closed current paths. Hoops 80 are individually electrically charged by wires 84 radially emanating from bus 66.

Having described the elements of the invention, the operation thereof will be described. The generator is instrumented with diagnostics to aid its operation. The current in winding 30S is sensed by a Rogowski coil near capacitor 42. The current in winding 30P is sensed by a Rogowski coil near capacitor 34. The Rogowski outputs are displayed with an oscilloscope. The voltage on capacitor 34 is obtained by means of a high voltage probe and displayed with an oscilloscope. A wattmeter monitors the power drawn from the mains by power supply 44. The output voltage of power supply 44 is monitored by suitable means.

The winding's temperature, during cool down, is inferred from the fall of the winding's resistance. The resistance measurement is made with a sensitive ohmmeter, and indirectly discloses when satisfactory operating temperature is obtained.

The Tesla transformer is energized after the vacuum is established in electron gun 24. The high-power pulsations are initiated by increasing the voltage on capacitor 34, by means of autotransformer 27, until conduction occurs at switch 38. Switch 38 is initially adjusted to conduct at a voltage substantially lower than that desired in final operation. The final operating voltage upon capacitor 34 is slowly approached by means of adjusting autotransformer 27 and insulating gas pressure in switch 38. The diagnostic displays are monitored for evidence of flashover within the Tesla transformer; and early conduction, poor deionization, and restrike in switch 38.

Power supply 44 is energized after satisfactory operation of the electron beam accelerator is obtained. The impedance match of power supply 44 with the ionized channel is obtained by maximizing the amount of power drawn by power supply 44 while holding its output voltage constant. The output voltage is controlled by the adjustment of autotransformer 45. The power drawn varies, and peaks at impedance match, by the number of transformers 50 communicating with bus 54.

We claim:

1. A directed electric discharge generator comprising:

(a) a very high voltage pulsed power supply connected to a commercial electric mains and driving a cold cathode electron gun possessing a gasdynamic window, disposed to introduce nonvacuum electron beam into the normal density atmosphere;

(b) means for periodically releasing relativistic electrons from said cold cathode electron gun at twice the frequency of the commercial electric mains, thereby producing an ionized channel of high electrical conductivity, in said normal density atmosphere, between the cathode of said cold cathode electron gun and a grounded target;

(c) an extra power supply;

(d) means to establish a sustained conduction current within said ionized channel, supplied by said extra power supply, to heat and rarify said channel, thereby economizing nonvacuum electron beam energy transport by reducing the collision frequency of said relativistic electrons and the air molecules intervening within said channel; and (e) means to match the impedance of said extra power supply to the resistive load of said ionized channel, thereby maximizing the power transfer efficiency.

2. The generator as recited in claim 1 wherein said very high voltage pulsed power supply is a repetitively pulsed Tesla transformer, including a primary winding magnetically coupled to a secondary winding, said secondary winding possessing an earth connection obtained through an isolation capacitor.

3. The generator as recited in claim 1 wherein said extra power supply includes:

a gang of parallel connected transformers of identical ratio and impedance characteristics;

means to vary the number of said transformers in said gang;

the primary side of said gang fed by an autotransformer, said autotransformer communicating with said commercial electric mains and controlling the output voltage of said gang;

a circuit to rectify and filter the output power of said gang;

a wattmeter to monitor the power drawn from said mains by said extra power supply; and, means to monitor the output voltage of said extra power supply.

4. The generator as recited in claim 2 wherein said extra power supply is connected across said isolation capacitor causing a sustained potential difference between said cathode and said grounded target, thereby producing said sustained conduction current within said ionized channel.

5. The generator as recited in claim 3 wherein said impedance matching means is obtained by maximizing said power drawn from said mains, by said extra power supply, by varying said number of transformers in said gang, with said output voltage of said extra power supply held constant by the adjustment of said autotransformer.

6. The generator as recited in claim 4 wherein said Tesla transformer possesses a spiral strip winding topology, of arbitrarily wide strip, thereby passing the current of said extra power supply with arbitrarily small loss.

7. The generator as recited in claim 6 wherein said primary winding and said secondary winding are submerged in a pressurized bath of liquid nitrogen, thereby obtaining liquid electrical insulation and reducing the electrical resistance of said arbitrarily wide strip.

* * * * *